US008157610B1

(12) United States Patent
Dietz et al.

(10) Patent No.: US 8,157,610 B1
(45) Date of Patent: Apr. 17, 2012

(54) LOCATION-SENSITIVE TOY AND METHOD THEREFOR

(75) Inventors: Paul H. Dietz, Hopkinton, MA (US); Edward A. Sotto, III, Los Angeles, CA (US); M. O. S. C. Jasba Simpson, Celebration, FL (US); Elise M. Fermier, McKinney, TX (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 09/547,931

(22) Filed: Apr. 11, 2000

(51) Int. Cl.
*A63H 30/00* (2006.01)

(52) U.S. Cl. ..... 446/175; 446/397; 446/297; 446/369; 446/268

(58) Field of Classification Search ..... 446/175, 446/297–303, 397, 268, 369; 340/825.36, 340/573, 686.1, 573.1, 686.6, 825.49, 384.7, 340/384.3, 1
See application file for complete search history.

(56) References Cited

U.S. PATENT DOCUMENTS 4,670,798 A 6/1987 Campbell et al.
4,729,751 A * 3/1988 Schiavo et al. ..... 446/268
4,796,301 A * 1/1989 Uzawa et al. ..... 398/118
4,882,694 A * 11/1989 Brubaker et al. ..... 180/168
4,912,457 A 3/1990 Ladd
4,973,944 A 11/1990 Maletta
4,973,952 A * 11/1990 Malec et al. ..... 340/825.36
4,984,098 A 1/1991 Buntsis
5,264,822 A 11/1993 Vogelman et al.
5,282,181 A * 1/1994 Entner et al. ..... 368/73
5,295,064 A * 3/1994 Malec et al. ..... 340/825.36
5,337,353 A * 8/1994 Boie et al. ..... 379/433.01
5,393,257 A * 2/1995 Spector ..... 446/27
5,406,271 A 4/1995 Sonnendorfer et al.
5,485,139 A 1/1996 Tarnovsky
5,495,137 A * 2/1996 Park et al. ..... 310/331
5,532,680 A 7/1996 Ousborne
5,646,593 A 7/1997 Hughes et al.
5,652,570 A 7/1997 Lepkofker
5,655,945 A 8/1997 Jani
5,664,948 A * 9/1997 Dimitriadis et al. ..... 340/989
5,713,780 A * 2/1998 Gallagher ..... 446/369
5,733,166 A * 3/1998 Hoag ..... 446/26
5,808,551 A 9/1998 Yarnall, Jr. et al.
5,831,348 A * 11/1998 Nishizawa ..... 340/310.07
5,844,489 A 12/1998 Yarnall, Jr. et al.
(Continued)

FOREIGN PATENT DOCUMENTS

EP 935225 A2 * 8/1999
(Continued)

*Primary Examiner* — Gene Kim
*Assistant Examiner* — Urszula M Cegielnik
(74) *Attorney, Agent, or Firm* — Ference & Associates LLC

(57) ABSTRACT

A small stuffed animal (10) is worn on the wrist of a user (14) and is held on via long arms featuring hook and loop fasteners. When the user wishes to activate the toy, the user places the animal's mouth close to the user's ear. A sensor (50) detects this action, and triggers one of many entertaining audio messages stored in the toy, thus creating the sensation of the animal whispering in the user's ear. In addition, the toy has a sensor (30) that can detect the presence of nearby location transmitters. This allows the toy to appropriately choose the audio messages to match the current location. Also, rather than waiting for the user to randomly discover the location driven messages, the toy alerts the user that it has an interesting message waiting.

24 Claims, 2 Drawing Sheets

U.S. PATENT DOCUMENTS

| | | | | | |
|---|---|---|---|---|---|
| 5,864,626 | A | * | 1/1999 | Braun et al. | 381/81 |
| 5,877,698 | A | | 3/1999 | Kusnier et al. | |
| 5,883,576 | A | | 3/1999 | De La Huerga | |
| 5,907,522 | A | | 5/1999 | Teodoridis et al. | |
| 5,923,252 | A | | 7/1999 | Sizer et al. | |
| 5,929,848 | A | * | 7/1999 | Albukerk et al. | 340/825.72 |
| 5,955,953 | A | | 9/1999 | Hanson et al. | |
| 5,991,601 | A | * | 11/1999 | Anderson | 455/38.4 |
| 6,040,774 | A | | 3/2000 | Schepps | |
| 6,072,392 | A | | 6/2000 | Henderson et al. | |
| 6,085,148 | A | * | 7/2000 | Jamison et al. | 701/211 |
| 6,089,942 | A | * | 7/2000 | Chan | 446/175 |
| 6,110,000 | A | * | 8/2000 | Ting | 446/297 |
| 6,116,977 | A | * | 9/2000 | Tanny et al. | 232/10 |
| 6,149,490 | A | * | 11/2000 | Hampton et al. | 446/298 |
| 6,160,986 | A | * | 12/2000 | Gabai et al. | 434/308 |
| 6,181,253 | B1 | * | 1/2001 | Eschenbach et al. | 340/825.37 |
| 6,200,193 | B1 | * | 3/2001 | Nadel | 446/409 |
| 6,227,931 | B1 | * | 5/2001 | Shackelford | 446/268 |
| 6,265,974 | B1 | * | 7/2001 | D'Angelo et al. | 340/568.1 |
| 6,273,421 | B1 | * | 8/2001 | Thalheimer et al. | 273/161 |
| 6,298,218 | B1 | * | 10/2001 | Lowe et al. | 455/66.1 |
| 6,309,275 | B1 | * | 10/2001 | Fong et al. | 446/175 |
| 6,326,918 | B1 | * | 12/2001 | Stewart | 340/686.1 |
| 6,352,478 | B1 | * | 3/2002 | Gabai et al. | 463/42 |
| 6,368,176 | B1 | * | 4/2002 | Lozowski et al. | 446/169 |
| 6,380,844 | B2 | * | 4/2002 | Pelekis | 340/5.8 |
| 6,631,179 | B1 | * | 10/2003 | Sifuentes | 379/88.01 |
| 2003/0067908 | A1 | * | 4/2003 | Mattaway et al. | 370/352 |

FOREIGN PATENT DOCUMENTS

| | | |
|---|---|---|
| JP | 2190888 | 7/1990 |
| JP | 3048283 | 5/1991 |
| JP | 7213751 | 8/1995 |
| JP | 8180649 | 7/1996 |
| JP | 8332284 | 12/1996 |
| JP | 9261139 | 10/1997 |
| JP | 9275371 | 10/1997 |
| JP | 9321889 | 12/1997 |
| JP | 11096230 | 4/1999 |
| JP | 11331901 | 11/1999 |
| JP | 2000078042 | 3/2000 |
| JP | 2000341376 | 12/2000 |
| JP | 6276135 | 7/2001 |
| WO | 0011793 | 3/2000 |

* cited by examiner

LOCATION-SENSITIVE TOY AND METHOD THEREFOR

CROSS-REFERENCES TO RELATED APPLICATIONS

Not applicable.

STATEMENT REGARDING FEDERALLY SPONSORED RESEARCH

Not applicable.

BACKGROUND OF THE INVENTION

1. Field of the Invention

The present invention relates generally to the field of toys, and, more particularly, to a toy for providing a location-sensitive behavior response to a user of the toy and method therefore. Although the present invention is subject to a wide range of entertainment environments, such as, cruise ships, theme parks, resorts, and resort hotels, it is especially suited for use in an entertainment environment, such as, an entertainment theme park or educational setting, and will be particularly described in that connection.

2. Description of the Related Art

Conventional mobile devices for playing location-dependent pre-recorded messages are known. Whenever a person carrying the mobile device comes within the range of a transmitter, the mobile device plays the pre-recorded message. One such mobile device is installed in a push-cart in the supermarket. When the push-cart is within range of a stationary transmitter, a pre-recorded message is sent to the mobile device. For example, the message can be a special discount offer for a particular product on a shelf nearby or an advertisement for a brand. The mobile device plays the same message for each shopper to hear when the device comes within the range of the receiver. The device can also be used in public galleries and parks for educational purposes, carried by a person, and connected to earphones to enable a shopper to hear the transmitted message without disturbing other shoppers.

Although suitable for applications where the same message is delivered to all shoppers, such a mobile device is not suitable for applications where it is desired to tailor the message to each shopper. Furthermore, the shopper has no control over the delivery of the message as the message is delivered and played automatically. Also, the earphones add to the expense of the unit and are obtrusive. These disadvantages can annoy the shopper and discourage the shopper's use of the device.

Moreover, a remotely controlled toy that modifies its behavior by how it moves and speaks in response to a control data signal received from a transmitter is known. A video- and radio-controlled moving and talking teddy bear receives the control data signal transmitted by a control device that is coupled to a VCR. The teddy bear moves and talks according to the control data signal. Although suitable for entertaining a child or children in the room with the teddy bear and control device, such a system is not suitable for tailoring the messages to different children in the room or providing control of the playing of the message to the child.

A need therefore exists for a toy, and method therefore, for an entertainment environment that modifies its behavior based upon its location. Further, it is desirable to have the behavior at least partially controlled by the user of the toy and tailored to the user.

BRIEF SUMMARY OF THE INVENTION

The present invention, which tends to address this need, resides in a toy and method therefore. The toy described herein provides advantages over known toys in that its behavior is location dependent, guest controllable, and tailored to the guest.

According to the present invention, the behavior of the toy is modified according to its location. Audio messages are stored in the toy and are played in response to receiving a location signal from a transmitter. This can be accomplished by an on-board receiver that receives the location signals, which represent locations in the theme park, and an on-board audio circuit that stores and plays the audio messages. A control circuit generates a message signal in response to the received location signal. The message signal indicates the stored audio messages that are to be played for the location. Thus, messages tailored for the user can be stored on the toy and selected and played according to the location of the user. The control circuit affords considerable sophistication in the logic that chooses messages to be played.

In accordance with one aspect of the present invention, the audio messages are played in response to the user's action. This can be accomplished by a proximiter that detects the presence of an object within a predetermined range of the proximiter. The audio circuit plays the indicated stored audio message or messages in response to the presence signal. Thus, the guest can choose to hear or not hear a message.

In a more detailed aspect of the present invention, the user is alerted that a message is waiting to be played. This can be accomplished by an alarm that is activated by the control circuit when a location signal is received. Thus, the user will know that he must act in order to hear the message.

In accordance with one aspect of the present invention, the audio messages are played in response to the user's action. This can be accomplished by a proximiter that detects the presence of an object within a predetermined range of the proximiter. The audio circuit plays the indicated stored audio messages in response of the presence signal. Thus, the guest can choose to hear or not hear a message.

Other features and advantages of the present invention will be set forth in part in the description which follows and accompanying drawings, wherein the preferred embodiments of the present invention are described and shown, and in part become apparent to those skilled in the art upon examination of the following detailed description taken in conjunction with the accompanying drawings, or may be learned by practice of the present invention. The advantages of the present invention may be realized and attained by means of the instrumentalities and combinations particularly pointed out in the appended claims.

DESCRIPTION OF THE PREFERRED EMBODIMENTS

Theme parks represent tremendous cash outlays that are amortized over decades. As the newness of the park wears off, it becomes increasingly difficult to maintain the excitement that attracts new and repeat visitors. Generally, theme park owners find it necessary to continually add major new attractions at ever increasing costs.

The "overlay" concept is to create exciting new experiences using mostly the existing infrastructure of the park. One such experience is for a visitor go through the park with an endearing and knowledgeable friend—one that is always with the visitor, having entertaining interactions with the visitor.

Figure 1:
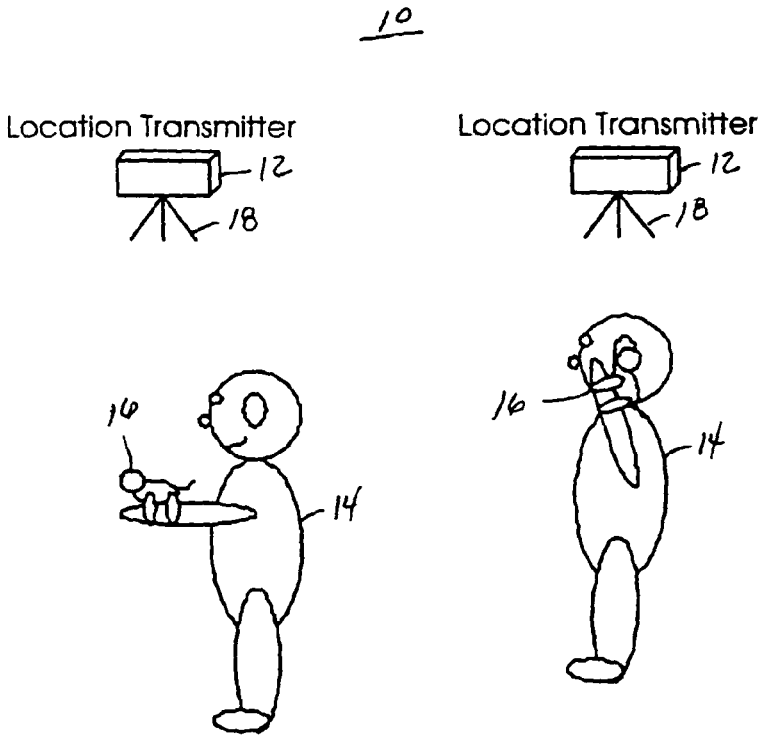
FIG. 1 is a simplified and generalized view of a theme park configured according to the present invention, particularly illustrating a plurality of location transmitters, toys, and users of the toys.

As shown in the exemplary drawings, and with particular reference to FIG. 1, which is a simplified and generalized view of a theme park 10 configured according to the present invention, illustrating a plurality of location transmitters 12 and users or guests 14 of the theme park, the present invention is embodied in a toy 16 that modifies its behavior based upon its location.

The toy can be a small stuffed animal that is worn on the wrist and can be held on via long arms featuring hook and loop fasteners. When the user wishes to activate the toy, the user places the animal's mouth close to the user's ear. A sensor detects this action, and triggers one or more entertaining audio messages, thus creating the sensation of the animal whispering in the user's ear. In addition, the toy has sensors that can detect the presence of nearby location transmitters. This allows the toy to appropriately choose the audio messages to match the current location. Also, rather than waiting for the user to randomly discover the location-driven messages, the toy alerts the user that it has an interesting message waiting.

Thus, the toy allows an existing theme park infrastructure to be used in entirely new ways, attracting first-time and repeat visitors to the theme park. The toy creates desirable new experiences in an old venue and does this in an endearing way, without detracting from the experience of guests who do not have toys.

In this illustrated embodiment, the location transmitters 12 are dispersed about the theme park 10, for example, at ride locations and entrances and exits of rides or pavilions. Each transmitter transmits a location signal 18 throughout its coverage area. The location signal represents the particular location that the toy occupies within the area of the theme park. A toy within the coverage area detects the location signal and thus "knows" its location within the theme park.

In the preferred embodiment, the location transmitters 12 emit a regular pattern of infrared flashes. These flashes are invisible to the human eye, but can easily be detected by appropriate sensors. In addition, the infrared energy can be focused and directed with lenses and mirrors to cover a very specific area. This allows transmitters to be closely spaced without creating significant interference among them. In this scheme, each location transmitter emits a uniquely coded signal, thus electronically labeling each coverage area with a specific location identification (ID) number. Suitable sensors and electronics in the toy can detect this location ID number. In turn, the toy can behave differently depending upon its location.

Figure 2:
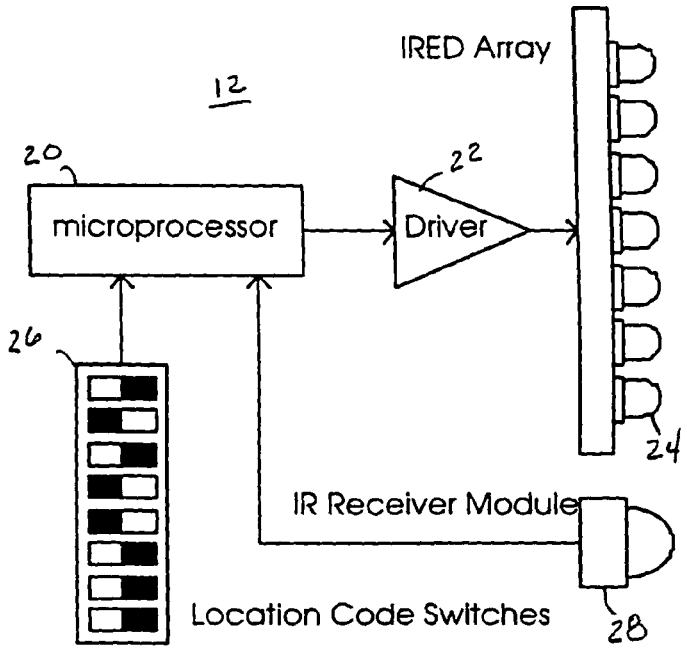
FIG. 2 is a generalized functional block diagram of the location transmitter shown in FIG. 1.

As shown in FIG. 2, which is a generalized functional block diagram of the location transmitter 12 shown in FIG. 1, the transmitter includes microprocessor 20 to generate the appropriate sequence of flashes for a given transmitter. A driver circuit 22 converts the voltage pulses from the microprocessor into current-limited pulses used to drive one or more infrared (IR) emitting diodes 24. A series of switches 26 is used to set the unique code for the transmitter. In addition, an IR receiver module 28 is employed to remotely control the location transmitter, for example, turning it on and off, changing the transmit code, or checking power levels. This is a desirable feature because the transmitters can be mounted in difficult to access locations. A suitable IR receiver is model number TSOP1838 available from Vishay Telefunken; and a suitable IR transmitter is model number TSAL6200 also available from Vishay Telefunken.

Although many different encoding schemes are possible, the preferred embodiment uses a 38 kilo-Hertz on-off keying modulation, 2400 baud, 8-bit, 1 start bit, 1 stop bit, no parity transmission format. This is similar to consumer appliance IR remote controls, allowing the use of standard components, such as, low-cost IR receiver modules.

A skilled artisan will appreciate that the toy can "know" its location by means other than receiving a location signal from a location transmitter. For example, the toy can have a location detection circuit that can determine its location by means such as the Global Positioning System, triangulation, imbedded induction coils, inertial guidance system, and the like.

Figure 3:
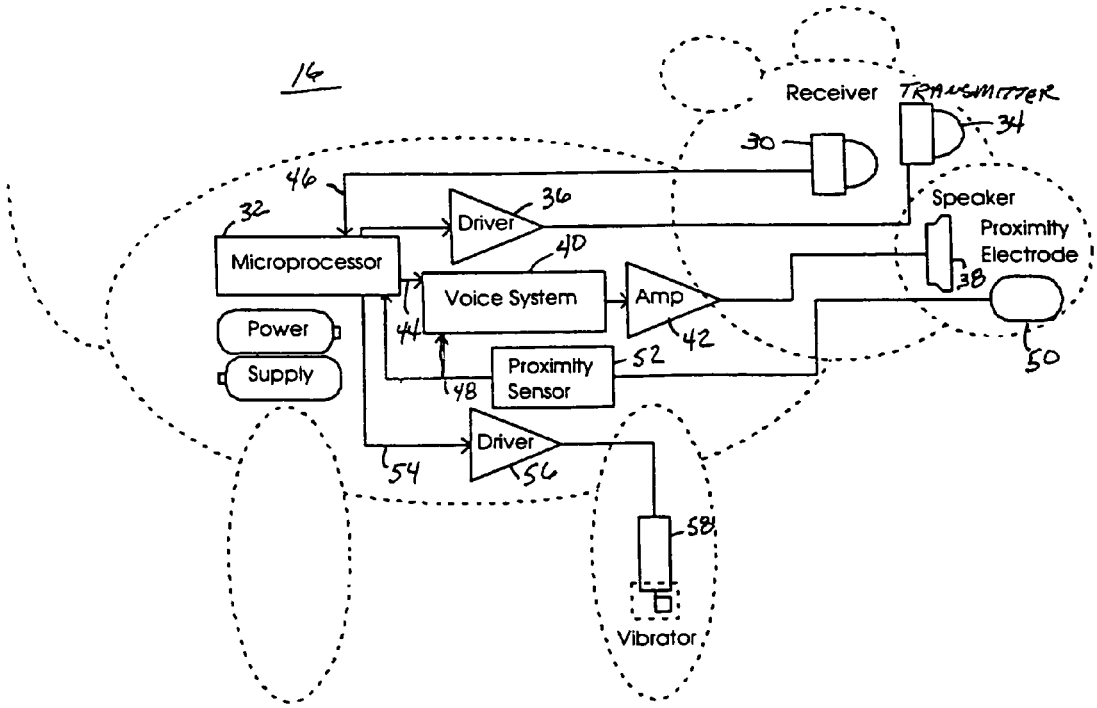
FIG. 3 is a generalized functional block diagram of the toy shown in FIG. 1.

FIG. 3 is a generalized functional block diagram of the toy 16 shown in FIG. 1. The toy can be a plush toy, such as, a stuffed animal. The hardware of the toy includes a receiver 30, a control circuit or microcontroller 32, an audio circuit, a proximiter, an alarm, and an on-board transmitter 34 and associated driver 36.

The receiver 30 receives the location signal 18 of the location transmitter 12 when the toy 16 enters the area of coverage. In response to the location signal, the receiver provides a received location signal 46. A suitable IR receiver is model number TSOP1838SS3V available from Vishay Telefunken. A skilled artisan will recognize that the receiver will depend upon the means chosen for determining the location of the toy.

The audio circuit stores the audio messages and plays them. The illustrated audio circuit includes a speaker 38, a voice system 40 that contains the stored audio messages, and an amplifier 42 for providing sufficient power to drive the speaker. A suitable voice system is model number 4003 available from Integrated Sound Devices; and any one of many commercially available speakers, such as those made by Panasonic, is suitable for the described application.

Although the microprocessor and audio circuit are shown separately, one of ordinary skill in the art will appreciate that these two components can be combined into an equivalent single audio processor circuit.

Storing the messages in the toy allows the messages to be tailored to the guest. For example, the messages can be in different languages. Or, messages for a parent user can be different than messages for a child user. Rather than hearing the same message when the parent and child are at the same location, the parent and child will hear different messages.

The control circuit 32, which can be any of a number of commercially available microprocessors, controls the actions of the toy. For example, the control circuit generates a message signal 44 in response to the received location signal 46. The message signal indicates a stored message, or group of messages, to be played by the audio circuit.

The proximiter detects the presence of an object within the range of the proximiter and generates a presence signal 48 in response thereto. In the illustrated embodiment, the proximeter includes a proximity electrode 50 and a proximity sensor circuit 52. A suitable proximiter is internal model number QT110-S available from Quantum Research Group, Limited. In this proximiter, the proximity electrode is a flexible tape that forms a capacitance. The change in capacitance, as the flexible tape which forms the nose of the animal is brought near to the user's ear, is used to detect the presence of the object. The flexible tape contributes to the "plushness" of the toy.

The audio circuit can be configured to play the indicated stored messages in response to the presence signal. Thus, the indicated stored audio message, or messages, can be heard by the user of the toy when the user places the toy next to the user's ear in the predetermined range of the proximiter.

The toy can also include an alarm feature. In the illustrated embodiment, the alarm includes a motor driver 56 and a vibrator 58, such as, a motor with an eccentric weight. Any number of suitable commercially available motor drivers and motors can be used.

The control circuit 32 can generate an alarm signal 54 in response to the received location 46. The alarm, in response to the alarm signal, notifies the user that the at least one stored audio message is waiting to be played by vibrating the toy.

The on-board IR transmitter 34 and associated driver 36 allow the toy to transmit signals. There are many possible uses for this capability. One is for the toy to collect performance data and transmit the data to a data collection system. The performance data can be the locations visited by the guest, the number of repeat visits to a location by a guest, the alerts that were responded to or ignored, power supply level, etc. A suitable on board transmitter is model number TSAL6200 available from Vishay Telefunken.

Another use is for a smart transmitter at a location to interrogate the toy to see what other locations the toy has been to. The behavior of devices or shows in the area of the location can be changed based on the previously visited locations.

Still another use is to periodically transmit a signal that can be detected by other toys. Thus a toy can discover the presence of another toy, and then the toys can appropriately interact. These interactions can be influenced by performance data, affording sophisticated behavior such as having one toy suggest places to visit that it has been to but the other has not.

The above-described hardware of the toy is hidden within the toy to keep the interactions as natural as possible. For example, the proximity electrode and speaker can be hidden in the mouth, the receiver and on-board transmitter in the eyes, and the vibrator in one of the legs. The other hardware can be hidden among the stuffing. Furthermore, using low-power devices for the hardware obviates the need for an on/off switch. These and other innovations taken together help create the illusion of an endearing friend.

The basic operation of a preferred embodiment of the toy will now be described.

First the user 14 attaches the toy 16 to his or her arm using, for example, the hook and loop fasteners on the limbs of the toy. Raising the toy to the user's ear will trigger one or more non-location specific audio messages. This action may be repeated as often as desired. When the user passes in the coverage area of a location transmitter 12, the toy detects the location identification code being transmitted, and then indicates the appropriate behavior sequence. Most typically, the behavior will be to shake the arm, wait for the user to place the toy up to his or her ear, and then play an audio message appropriate to that location. If the user does not respond to the toy's request for attention, the toy will repeat the notification by shaking again.

If the user still does not respond, it will return to its normal quiet mode. In case a loud noise or other event prevented the user from hearing a message while being played, there is an instant replay feature. This will allow the user to replay the message, with a short explanatory header or preamble such as "I said," by placing the toy to his or her ear once again. This feature can time out after a reasonable period to prevent giving inappropriate messages in a different location.

The present invention is capable of other and different embodiments, and its several details are capable of modification. As a skilled artisan will appreciate, a behavior control circuit, which in the preferred embodiment includes the control circuit 32, the audio circuit, the proximiter, and the alarm, can modify the behavior of the toy to affect the user's senses beyond hearing and touching. The sensory impressions may be audio and physical movement as described above and heat, smell, and visual changes, for example, lighting a bulb or changing the display of a liquid crystal display.

Furthermore, the behavior control of the toy can depend upon items such as the history of locations the toy has visited, the history of how the toy has behaved in previous locations, time, and history of how the user has interacted with the toy.

An example of behavior control dependent upon the history of locations the toy has visited includes modifying the behavior based on whether a ride in the area was already ridden. For example, upon exiting a ride after the user has ridden it, the exit transmitter sends a signal to the toy that is stored as a flag indicating that the user has ridden the ride by the user of the toy. Upon reentering the area of the ride, a different message may be played than the message that was played upon first entering the area of the ride. Another example is for the toy to play a message that the ride the user is near is similar to a ride the user has ridden in another location. Further, the toy may suggest other rides to ride that are unlike rides already ridden. Directions may also be given that depend upon the user's path through the park.

An example of behavior control dependent upon the history of how the toy has behaved in a previous location includes modifying the behavior based on setting up a joke in one location and giving the punch line in another location only if the set up of the joke was given. Another example is changing the set of messages if entering a location for a second time or playing messages for the location that were not heard the first time while in the location.

An example of behavior control dependent upon time includes modifying the behavior based on the time of day, the time of day in a location, or time of day in a previous location. For example, the toy can suggest lunch when passing a restaurant location when the time of day is between the hours of, for example, 11:00 a.m. and 2:00 p.m. Further, the toy will not play a message suggesting lunch at lunch time if it knows that the user was in a restaurant location during the lunch period. Another example of time dependency is to play self-timed messages depending upon the location. For example, if the user is standing in a long line waiting to enter a ride, a group of messages separated in time can be played to keep the user entertained while waiting.

An example of behavior control dependent upon the history of how the user has interacted with the toy includes modifying the behavior of the toy based on whether the user responds to certain types of messages. For example, the toy can detect whether the user responds to certain types of messages, and, if not, suppress them in the future.

The control circuit and audio circuit affords considerable sophistication in the logic that chooses messages to be played. For example, some messages can only be played once, while others can be played multiple times. Other messages can depend upon seeing identification codes from a sequence of location transmitters rather than just one. One of ordinary skill in the art can easily program the control circuit to generate a message signal that selects the message or messages to be played.

In addition to the typical response to a location code, more elaborate behaviors are possible. For example, a location transmitter can be set up at a narrow entrance to an area and a separate location transmitter at the exit, rather than trying to blanket the entire area with transmitters. In this case, the toy can go into a self-timed mode, where it periodically gives messages in between the two transmitters. The feature of a self-timed mode and periodic messages can also be applied to a user that remains within the coverage of a transmitter.

In conclusion, the toy described herein provides an exciting overlay to a theme park. The toy plays messages that are location-dependent, guest controllable, and tailored to the guest. This is primarily accomplished by storing audio messages in a wearable toy and having the messages played by the toy in response to location signals and actions of the user.

Those skilled in the art will recognize that other modifications and variations can be made in the toy of the present invention and in construction and operation of this toy without departing from the scope or spirit of this invention.

What is claimed is:

1. A toy comprising:

a stuffed animal body having therein:

an audio circuit configured to receive a message signal, the message signal indicating a stored audio message is to be played by the audio circuit;

a plurality of audio messages stored in the audio circuit, wherein the audio circuit is configured to play one or more of the stored plurality of audio messages in response to a presence signal;

means for generating the presence signal in response to detecting a presence of a body part within a predetermined range;

means configured for receiving one or more of a plurality of location signals comprising an infrared signal having a uniquely coded signal electronically labeling a coverage area within an amusement park with a specific location identification; and means within the toy coupled to the receiver and coupled to the audio circuit for generating the message signal in response to the received location signal.

2. The toy of claim 1, wherein the means for generating the message signal is configured to generate the message signal in response to consulting a stored history of locations the toy has visited.

3. The toy of claim 1, wherein the means for generating the message signal is configured to generate the message signal in response to consulting a stored history of how the toy has behaved in previous locations.

4. The toy of claim 1, wherein the means for generating the message signal also generates the message signal in response to the time of the day.

5. A plush toy comprising:

an audio circuit within the plush toy coupled to receive a message signal, the message signal indicating a stored audio message is to be played by the audio circuit;

a plurality of audio messages stored in the audio circuit, wherein the one or more of the stored plurality of audio messages is played responsive to generation of the message signal by a control circuit;

means within plush toy for generating a presence signal in response to detecting a presence of a body part within a predetermined range, the presence signal being configured to control a timing of playing of one or more of the one or more stored plurality of audio messages;

means for receiving one or more of a plurality of location signals comprising a uniquely coded signal electronically labeling a coverage area within an amusement park with a specific location identification;

means for generating the message signal coupled to the receiver and the audio circuit, the means for generating the message signal being configured to generate the message signal in response to the received location signal, the message signal indicating at least one stored audio message to be played the by the audio circuit;

wherein the audio circuit is configured to repeat the at least one stored audio message each time the presence signal is generated; and wherein the audio circuit is configured to first play a preamble before each subsequently repeated playing of the at least one stored audio message.

6. The toy of claim 1, wherein the means for generating the message signal is further configured to generate an alarm signal in response to the received location signal for notifying the user that the at least one stored audio message is waiting to be played.

7. The toy of claim 6, wherein the means for generating the message signal is configured to repeat the alarm until the presence signal is generated.

8. A toy for outputting in voice at least one audio message to a user of the toy, the toy comprising:

an audio circuit for storing a plurality of audio messages and for outputting in voice the stored plurality of audio messages;

means for generating a presence signal in response to detecting a presence of a body part within a predetermined range;

a means for receiving a plurality of location signals which are sent from a plurality of transmitters provided in a plurality of locations in a predefined area that the toy can occupy, each of said location signals representing a respective one of said plurality of locations; and means for generating a message signal in response to the received location signal, the message signal indicating the at least one stored audio message to be output in voice by the audio circuit;

wherein the audio circuit outputs in voice at least one stored audio message of the stored plurality of audio messages in response to the presence signal.

9. The toy of claim 8, wherein said means for generating a message signal generates said message signal in response to a time of day and a received location signal.

10. The toy of claim 8, wherein the audio circuit repeats the at least one stored audio message each time the presence signal is generated.

11. The toy of claim 10, wherein the audio circuit outputs in voice a preamble before each subsequently output at least one stored audio message.

12. The toy of claim 11, further comprising:

an alarm, generating an output in response to an alarm signal, for notifying a user that the at least one stored audio message is indicated to be output in voice;

wherein the means for generating a message signal further generates the alarm signal in response to the received location signal.

13. The toy of claim 12, wherein the alarm repeats notifying the user that the at least one stored audio message is indicated to be output in voice until the presence signal is generated.

14. A toy for use in an entertainment environment, the toy comprising:

a location detection circuit for detecting the location of the toy in the entertainment environment; and a behavior control circuit for modifying behavior of the toy in response to the determined location;

wherein:

in order to detect the location of the toy, the location detection circuit comprises a receiver for receiving a plurality of location signals which are sent from a plurality of transmitters provided in a plurality of locations in a predefined area that the toy can occupy, each of said location signals representing a respective one of said plurality of locations;

the behavior control circuit comprises:

an audio circuit for storing a plurality of audio messages and for playing the stored plurality of audio messages;

means for generating a message signal in response to the received location signal, the message signal indicating at least one stored audio message to be output in voice by the audio circuit; and means for generating a presence signal in response to detecting a presence of a body part within a predetermined range;

wherein the audio circuit outputs in voice the at least one stored audio message in response to the presence signal.

15. The toy of claim 14, wherein the means for generating a message signal further generates an alarm signal in response to the received location signal; and wherein the behavior control circuit further comprises an alarm, generating an output in response to the alarm signal, for notifying a user that the at least one stored audio message is indicated to be output in voice.

16. The toy of claim 15, wherein the alarm generates said output repeatedly so as to notify a the user that the at least one stored audio message is indicated to be output in voice.

17. The toy of claim 15, wherein the alarm includes a vibrator for generating vibration as said output.

18. The toy of claim 14, wherein the audio circuit re-outputs in voice the at least one stored message each time the presence signal is generated.

19. The toy of claim 14, wherein the audio circuit periodically outputs in voice the at least one stored audio message when a same location signal is continuously received by said receiver.

20. The toy of claim 14, wherein the audio circuit periodically outputs in voice selected messages of the at least one stored audio message until a different location signal is received by said receiver.

21. The toy of claim 14, further comprising a transmitter for reversely transmitting data of the toy.

22. A method of controlling the behavior of a toy, the method comprising the steps of:

storing a plurality of audio messages in an audio circuit in the toy;

generating a presence signal, with means for generating the presence signal provided in said toy, in response to detecting a presence of a body part within a predetermined range of the toy;

receiving a plurality of location signals being sent from a plurality of transmitters provided in a plurality of locations in a predefined area that the toy can occupy, each of said plurality of location signals with means for generating a message signal representing a respective one of said plurality of locations;

generating a message signal with provided in said toy in response to the received location signal, the message signal indicating the at least one stored audio message to be output in voice by the audio circuit; and outputting in voice by said audio circuit at least one stored audio message, indicated by said message signal, in response to said presence signal.

23. A method of using a toy in an entertainment environment, the method comprising the steps of:

storing a plurality of audio messages in an audio circuit provided in the toy;

determining a location of the toy in the entertainment environment; and controlling the behavior of the toy in response to the determined location;

wherein, in order to determine the location of said toy, said step of determining the location of the toy in the entertainment environment includes a step of receiving a plurality of location signals with a receiver provided in the toy, said plurality of location signals being sent from a plurality of transmitters provided in a plurality of locations in a predefined area that the toy can occupy, each of said location signals representing a respective one of said plurality of locations; and wherein said step of controlling the behavior of the toy in response to the determined location includes a step of generating a message signal with a controlling circuit provided in the toy in response to the received location signal, the message signal indicating at least one stored audio message to be output in voice by the audio circuit, a step of generating a presence signal in response to detecting a presence of a body part within a predetermined range of the toy by means for generating the presence signal provided in the toy, and a step of outputting in voice by said audio circuit the at least one stored audio message indicated by said message signal in response to the presence signal.

24. The method of claim 23, wherein said step of controlling the behavior of the toy in response to the determined location further includes a step of generating an alarm signal in response to the received location signal and a step of generating an output for notifying a user, in response to the alarm signal, that the at least one stored audio message is indicated to be output in voice.

* * * * *